US005901684A

United States Patent [19]

Fiaschetti et al.

[11] Patent Number: 5,901,684

[45] Date of Patent: May 11, 1999

[54] METHOD FOR PROCESSING CRANKSHAFT SPEED FLUCTUATIONS FOR CONTROL APPLICATIONS

[75] Inventors: John Fiaschetti, Rochester Hills; Kenneth DeGroot, Macomb Township; Mark Borland, Birmingham; Gregory Weber, Commerce Township, all of Mich.

[73] Assignee: DaimlerChrysler Corporation, Auburn Hills, Mich.

[21] Appl. No.: 09/152,762

[22] Filed: Sep. 14, 1998

Related U.S. Application Data

[63] Continuation-in-part of application No. 08/901,859, Jul. 29, 1997, Pat. No. 5,809,969.

[51] Int. Cl.[6] ..... F02D 41/04

[52] U.S. Cl. ..... 123/436; 73/117.3; 701/110

[58] Field of Search ..... 123/419, 436, 123/480, 491; 73/116, 117.3; 701/104, 110, 111

[56] References Cited

U.S. PATENT DOCUMENTS

| | | | |
|---|---|---|---|
| 4,829,963 | 5/1989 | Oblaender et al. | 123/436 |
| 5,050,554 | 9/1991 | Ichikawa | 123/419 |
| 5,237,862 | 8/1993 | Mangrulkar et al. | 73/116 |
| 5,426,587 | 6/1995 | Imai et al. | 123/419 |
| 5,492,102 | 2/1996 | Thomas et al. | 123/493 |
| 5,544,521 | 8/1996 | McCombie | 73/117.3 |
| 5,605,132 | 2/1997 | Hori et al. | 123/436 |
| 5,630,397 | 5/1997 | Shimizu et al. | 123/436 |
| 5,809,969 | 9/1998 | Fiaschetti et al. | 123/436 |

*Primary Examiner*—Tony M. Argenbright
*Attorney, Agent, or Firm*—Mark P. Calcaterra

[57] ABSTRACT

A methodology of computing a learned combustion stability value and applying the learned combustion stability value to control engine operation is provided. Engine speed is sensed for each expected firing of individual cylinders ofthe engine. An expected acceleration value is determined using a band-pass-filtered engine speed difference. The difference between successive expected acceleration values is computed. A learned combustion related value is determined as a function of the difference in the successive learned acceleration values and is an indication of engine combustion quality. The operation of the engine is controlled as a function of the learned combustion related value. The learned combustion stability value is advantageously employed so as to modify the fuel injection to an internal combustion engine, especially following a cold engine start so as to reduce hydrocarbon emissions. This is accomplished by modifying a program target fuel injection value as a function of the learned combustion related value so as to reduce the fuel injected into the engine by fuel injectors.

4 Claims, 3 Drawing Sheets

METHOD FOR PROCESSING CRANKSHAFT SPEED FLUCTUATIONS FOR CONTROL APPLICATIONS

This application is a continuation-in-part of U.S. application Ser. No. 08/901,859, filed Jul. 29, 1997, now U.S. Pat. No. 5,809,969 and assigned to the same assignee as the instant invention.

BACKGROUND OF THE INVENTION

1. Technical Field

The present invention relates generally to internal combustion engines in automotive vehicles and, more particularly, to a method of determining combustion stability of the engine and controlling the fuel injection pulsewidth to fuel injectors for the engine, especially following a cold start.

2. Discussion

Automotive vehicles commonly employ a port-injected internal combustion engine in which a fuel injector sprays fuel into air in an intake manifold of the engine near an intake valve of a cylinder as air gets pulled into the cylinder during the cylinder's intake stroke. The conventional fuel injector is typically controlled in response to a fuel injection pulsewidth signal in which the pulsewidth determines the amount of fuel injected into the corresponding cylinder of the engine. The fuel injection pulsewidth signal can be implemented to follow a programmed target fuel injection curve. The programmed target fuel injection curve determines the fuel injection pulsewidth and is generally utilized to provide adequate engine performance when feedback engine control is not available.

Many automotive vehicles commonly employ an oxygen ($O_2$) sensor generally disposed upstream of the exhaust system for sensing the oxygen level in the exhaust gas emitted from the engine. The oxygen sensor can serve to provide a feedback signal to control engine operation and adjust fuel injection to the engine to achieve good engine performance. However, some conventional oxygen sensors are required to warm up to a sufficiently high temperature before an accurate oxygen sensor reading may be obtained. Also, following an engine start, the oxygen sensor and processing devices initially may not have acquired enough information to provide adequate feedback control. Therefore, for a period of time immediately following cold start up of the vehicle engine, the oxygen sensor may not be capable of providing accurate information with which the engine may be controlled to operate to achieve low hydrocarbon emissions. As a consequence, excessive hydrocarbon emissions may be emitted from the vehicle within the immediate period following start up of the engine.

Additionally, immediately following a cold engine start, the catalyst of the catalytic converter can be ineffective since the catalyst requires a period of time to warm up to a temperature at which the catalyst can operate effectively to burn excess hydrocarbons. As a consequence, hydrocarbon emissions may initially be high due to poor burning of the excess hydrocarbons due to a low temperature catalyst. To add to the problem, an over abundance of fuel in the catalyst may further cool the catalyst, thereby requiring an extended period of time for the catalyst to warm up to a sufficient operating temperature.

One approach for modifying fuel injection to the engine is described in U.S. Pat. No. 5,492,102, entitled "Method of Throttle Fuel Lean-Out for Internal Combustion Engines", issued to Thomas et al. on Feb. 20, 1996. The aforementioned issued U.S. patent in incorporated herein by reference. The approach described in the above-identified issued patent calculates a fuel lean-out multiplier value which is applied to a fuel pulsewidth value of the fuel injectors to reduce the amount of fuel injected into the engine by the fuel injectors. In the aforementioned approach, the fuel lean-out multiplier value is determined based off of a sensed throttle position and sensed deceleration.

It has also become increasing desirable to evaluate the combustion performance of the engine to improve control of the engine. In addition to controlling engine operation, combustion measurement can be used to evaluate hardware changes made to the engine. Combustion stability of the engine can be measured by processing engine speed signals taken over an angular displacement of the expansion stoke for each cylinder of the engine. By computing a roughness measurement of combustion, the combustion value can be used to control engine operation despite hardware changes.

It is therefore one object of the present invention to provide for control of a vehicle engine based on a learned measurement of combustion stability of the engine.

It is another object of the present invention to provide for a learned combustion stability value which may be employed to control engine operation while maintaining adequate driveability and performance of the vehicle.

More particularly, it is an object of the present invention to provide for a learned combustion stability value and apply the learned combustion stability value to modify the pulsewidth signal to fuel injectors of the engine so as to reduce the amount of fuel applied to the engine to reduce hydrocarbon emissions, especially following a cold engine start.

SUMMARY OF THE INVENTION

In accordance with the teachings of the present invention, a methodology of computing a learned combustion stability value and applying the learned combustion stability value to control engine operation is provided. Engine speed is sensed for each expected firing of individual cylinders of the engine. The difference in engine speed for a selected cylinder firing and a cylinder firing occurring a predetermined number of cylinder firings earlier is determined to provide an expected acceleration value. The difference in successive expected acceleration values is computed to provide a jerk value. A learned combustion related value is determined as a function of the difference between the successive learned acceleration values and may be used as an indication of engine roughness. The operation of the engine is controlled as a function of the learned combustion related value.

According to one embodiment, the learned combustion stability value is advantageously employed so as to modify the fuel injection to an internal combustion engine, especially following a cold engine start so as to reduce hydrocarbon emissions. This is accomplished by modifying a programmed target fuel injection signal pulsewidth as a function of the learned combustion related value so as to reduce the fuel injected into the engine by fuel injectors. By reducing fuel injection as a function of the learned combustion stability value, reduced hydrocarbon emissions can be realized while maintaining good driveability and performance of the vehicle.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENT

Figure 1:
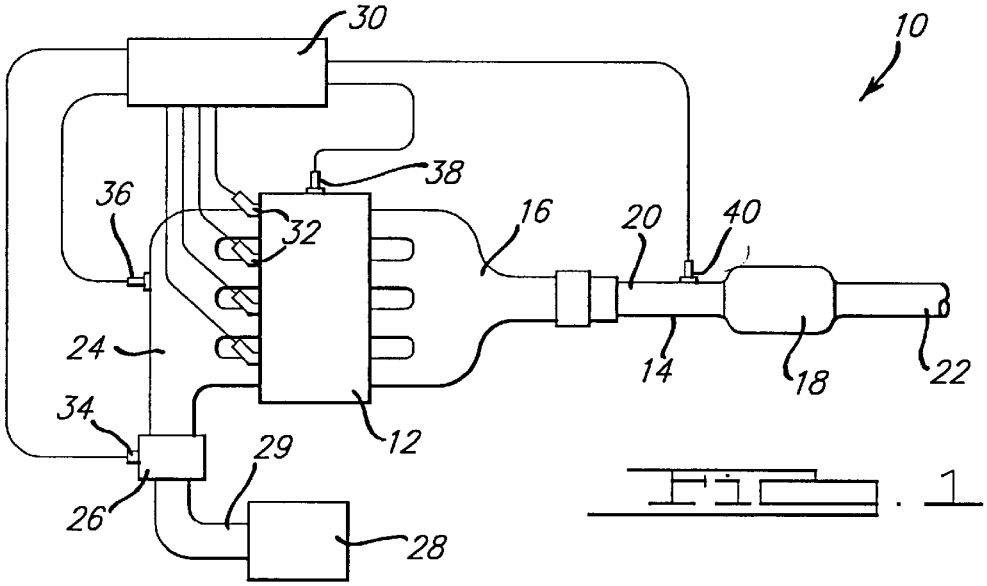
FIG. 1 is a schematic diagram of an electronic fuel injection system illustrated in operational relationship with an internal combustion engine and exhaust system of an automotive vehicle.

Turning now to FIG. 1, an electronic fuel injection system 10 is illustrated in operational relationship with an internal combustion engine 12 and an exhaust system 14 of an automotive vehicle (not shown). The exhaust system 14 includes an exhaust manifold 16 connected to the engine 12 and a catalyst 18 such as a catalytic converter connected by an upstream conduit 20 to the exhaust manifold 16. The exhaust system 14 also includes a downstream conduit 22 connected to the catalyst 18 and extending downstream to a muffler (not shown). The internal combustion engine 12 is a fuel injected engine and includes an intake manifold 24 connected to the engine 12 and a throttle body 26 connected to the intake manifold 24. The engine 12 also includes an air filter 28 connected by a conduit 29 to the throttle body 26. It should be appreciated that the engine 12 and exhaust system 14 are conventional and known in the art.

The electronic fuel injection system 10 includes an engine controller 30 having fuel injector outputs 32 connected to corresponding fuel injectors (not shown) of the engine 12. The fuel injectors meter an amount of fuel to cylinders (not shown) of the engine 12 in response to a pulsewidth value output from the engine controller 30 via fuel injector output lines 32. The electronic fuel injection system 10 also includes a throttle position sensor 34 connected to the throttle body 26 and the engine controller 30 to sense an angular position of a throttle plate (not shown) in the throttle body 26. The electronic fuel injection system 10 includes a manifold absolute pressure (MAP) sensor 36 connected to the intake manifold 24 and the engine controller 30 to sense manifold absolute pressure. The electronic fuel injection system 10 also includes a coolant temperature sensor 38 connected to the engine 12 and the engine controller 30 to sense a temperature of the engine 12. The electronic fuel injection system 10 further includes an oxygen ($O_2$) sensor 40 connected to the upstream conduit 20 of the exhaust system 14. The oxygen sensor 40 is also connected to the engine controller 30 to sense the oxygen level in the exhaust gas from the engine 12. It should be appreciated that the engine controller 30 and sensors 34, 36, 38 and 40 are conventional and known in the art.

Figure 2:
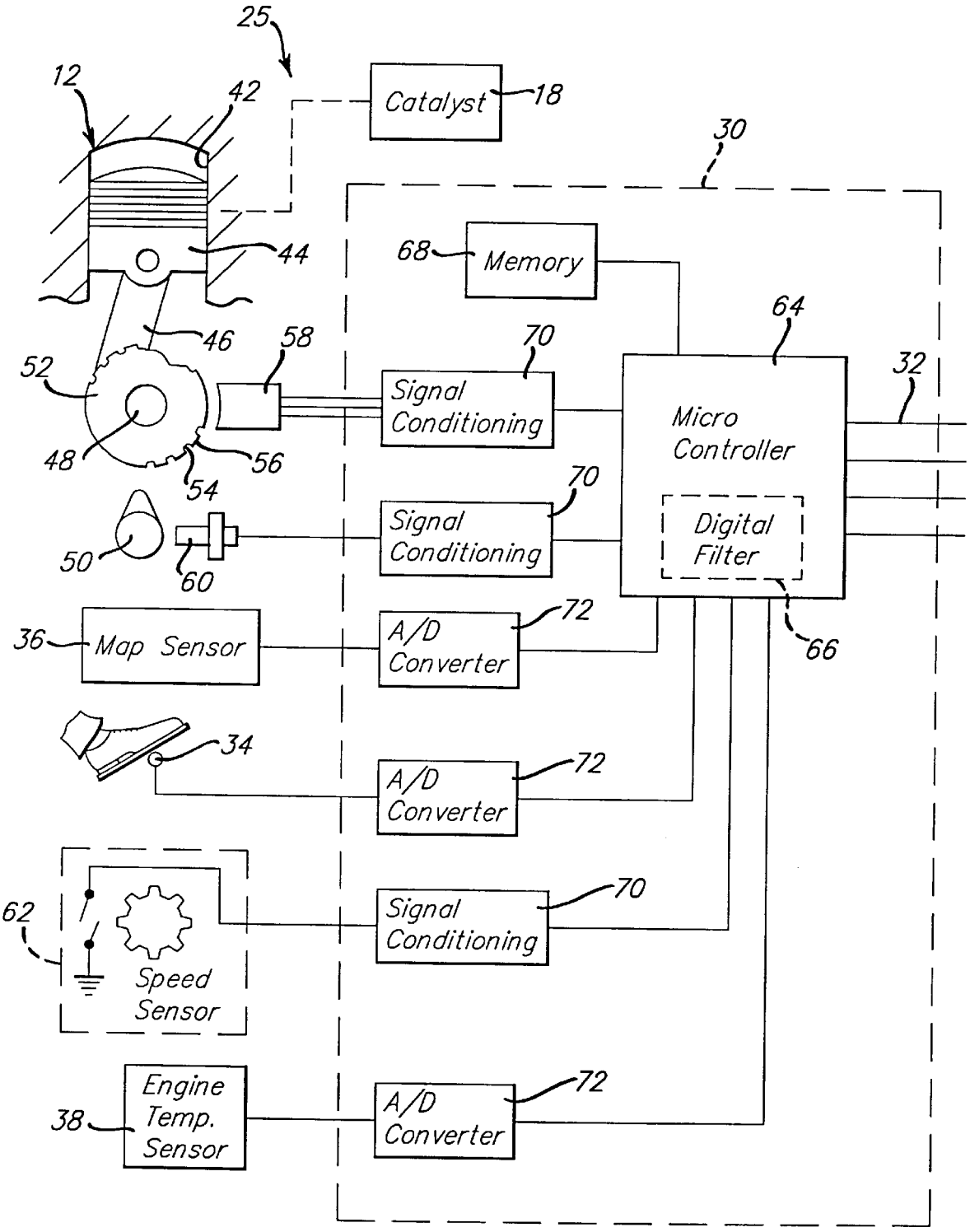
FIG. 2 is a block diagram further illustrating components of a vehicle used for sensing engine speed from a crankshaft and modifying fuel injection to the engine.

Referring to FIG. 2, a block diagram is provided which illustrates the components of the automotive vehicle 25 for measuring engine speed, determining a combustion related value and modifying fuel injection to the engine. A partial cut-away view of engine 12 is shown illustrating one of a multiple of cylinders 42 in the engine 12. As illustrated, a piston 44 is disposed in the cylinder 42 and is operatively connected by a connecting rod 46 to a crankshaft 48. A camshaft 50 is used to open and close at least one valve (not shown) of the cylinder 42 for various strokes of the piston 44. The piston 44 is illustrated in the expansion (power) stroke of a four stroke engine. In such a four stroke engine, the strokes include intake, compression, expansion (power), and exhaust. During the exhaust stroke, exhaust gases flow from the cylinder 42 via at least one valve and through the exhaust system 14. Although the embodiment shown is a four stroke engine, the principles of the present invention can also be applied to other internal combustion engines, such as a two stroke engine. It should be appreciated that a spark plug is present in the preferred embodiment, although it is not illustrated herein.

The automatic vehicle 25 further includes a sensor target 52 operatively connected to the crankshaft 48. The sensor target 52 has at least one, and preferably a plurality of trip points, which in the preferred embodiment are provided as slots 54, formed by teeth 56. The vehicle 25 also includes a crankshaft sensor 58 for communicating with the sensor target 52 and a camshaft sensor 60 in communication with the camshaft 50. The vehicle 25 further includes the manifold absolute pressure (MAP) sensor 36, throttle position sensor 34, a vehicle speed sensor 62 and an engine temperature sensor 38. The outputs of the sensors 58, 60, 36, 34, 62 and 38 communicate with the engine controller 30.

The engine controller 30 includes a micro-controller 64 with a digital filter 66, memory 68, signal conditioning circuitry 70 and analog-to-digital (A/D) converters 72 to process outputs from the various sensors according to the methodology to be described hereinafter. In the preferred embodiment, the outputs of crankshaft sensor 58, camshaft sensor 60, and vehicle speed sensor 62 communicate with the micro-controller 64 via appropriate signal conditioning circuitry 70 which is particularized to the type of sensor employed. The output of the manifold absolute pressure sensor 36, throttle position sensor 34 and engine coolant temperature sensor 38 communicate with the micro-controller 64 via the A/D converters 72. The engine controller 30 including microcontroller 64 with digital filter 66 is used to determine a learned combustion stability value and modify a fuel injection control signal as will be described in more detail hereinafter. Memory 68 is a generic memory which may include Random Access Memory (RAM), Read Only Memory (ROM) or other appropriate memory. It should also be appreciated that the engine controller 30 also includes various timers, counters and like components.

Figure 3:
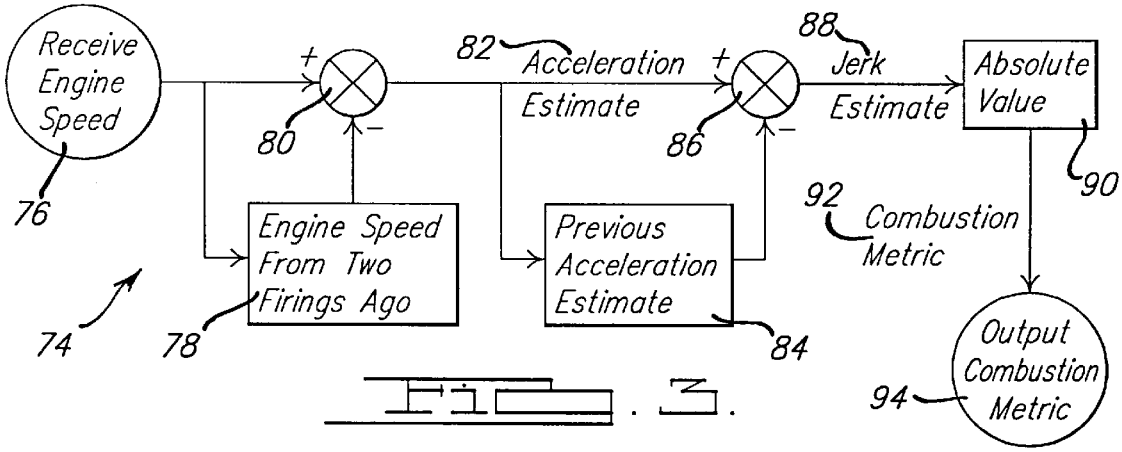
FIG. 3 is a flow diagram illustrating a methodology of computing a learned combustion metric value indicative of the combustion stability of the engine according to the present invention.

With particular reference to FIG. 3, a methodology 74 of computing a learned combustion-related value which is indicative of the combustion roughness of the engine is provided. Methodology 74 may be carried out by engine controller 30 including micro-controller 64 with digital filter 66. Methodology 74 receives an engine speed signal 76 signal which may be determined as described above for each expected cylinder firing event. One intent of the methodology is to create a band pass filtering effect of the engine speed signal. Use of an engine speed value observed for the cylinder of interest two firing events previous to the current cylinder firing event has been found to create the desired filtering effect with an acceptable pass band. It will understood by those skilled in the art that any implementation of an equivalent band pass filtering of the engine speed signal is contemplated by this invention.

Hence, as seen from FIG. 3, the engine speed signal for the current cylinder firing event (n) is compared with the engine speed signal occurring two firing events earlier (n-2) prior to the current cylinder firing event as shown by comparison block 80. The comparison block 80 provides a difference value between the current (n) engine speed and the engine speed determined two firing events earlier (n-2). The determined difference value is identified as an acceleration estimate value 82. The current (m) acceleration estimate value 82 is compared with the previous (m-1) acceleration estimate value 84 via a comparator 86. Comparator 86 computes the difference between the current (m) acceleration estimate value and the previous (m-1) acceleration estimate value and outputs a jerk estimate value 88. An absolute value of the jerk estimate value 88 is taken in block 90 and provides a positive output value 90 which is identified as a combustion metric value 92. As an alternate embodiment, methodology 74 could mathematically square the jerk estimate value 88 instead of taking the absolute value. The square function would still provide a positive output value. The combustion metric value 92 is shown output pursuant to block 94. Accordingly, methodology 74 computes an output combustion metric value based on the difference between successive acceleration estimate values as determined from the received engine speed signal. The output combustion metric value is a learned value indicative of the combustion stability of the engine and therefore provides an indication of the roughness of the engine combustion.

Figure 4:
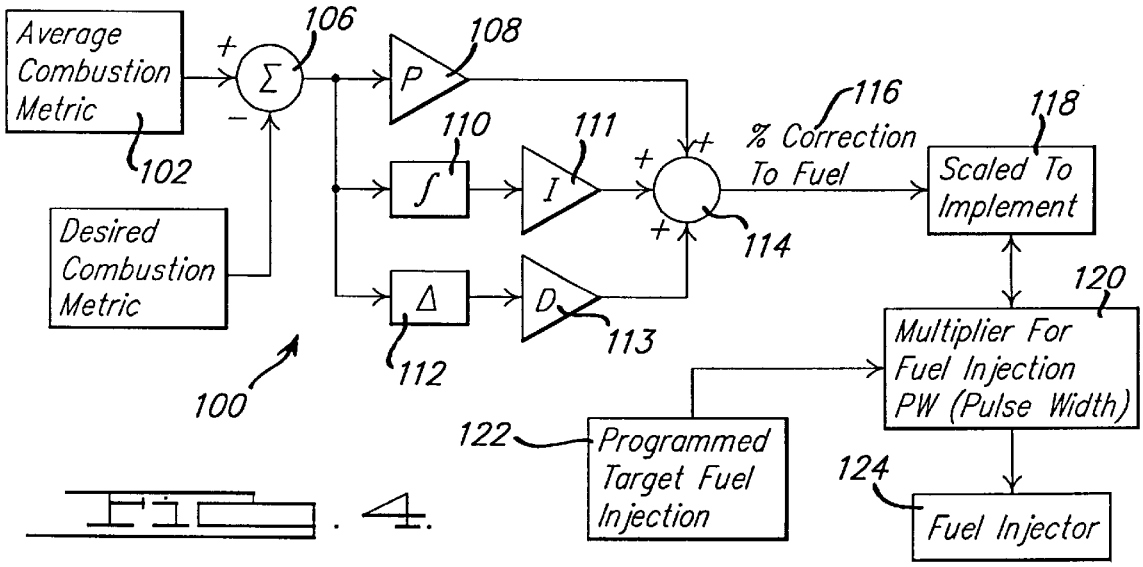
FIG. 4 is a flow diagram illustrating use of the computed learned combustion metric value to modify fuel injection to an engine according to the present invention.

Referring to FIG. 4, a methodology 100 is illustrated for modifying the fuel injection pulsewidth signal to fuel injectors of the engine as a function of the combustion metric value according to the present invention. Fuel injection modification methodology 100 computes an average combustion metric value from the combustion metric value as provided in block 102 and compares the average combustion metric value with a desired combustion metric value 104 as provided by comparator 106. The desired combustion metric value is preferably programmed as a function of engine speed, manifold absolute pressure and coolant temperature and offers a control signal for controlling the fuel injection to the engine. Comparator 106 outputs a difference value between the average combustion metric value and the desired combustion metric and provides proportional-integral-derivative (PID) control. The PID control includes a proportional (P) gain block 108, an integral (∫) block 110, and a differential (Δ) block 112. Each of the proportional, integral and differential blocks 108, 110 and 112, respectively, receives the output from comparator 106. The output from the proportional gain block 108 is applied to a summation block 114. The output of the integral block 110 is applied to a gain (I) block 111 and then output to the summation block 114. The output of the differential block 112 is applied to a gain (D) block 113 and then output to the summation block 114. The summation block 114 sums the inputs so as to provide a percentage correction value 116 that in turn is used to modify the fuel injection to the engine. The percentage correction value 116 is scaled in block 118 for implementation as a multiplier value. Scaling of the percentage correction value may be accomplished by adding 1.0 to the fractional percentage correction value, according to one embodiment. Methodology 100 provides a multiplier for the fuel injection pulsewidth such that the amount of fuel injected to the engine may be reduced from the scheduled amount provided in the programmed target fuel injection value 122. Accordingly, the programmed target fuel injection 122 is scaled by way of the multiplier 120 to realize a reduction of fuel supplied by the fuel injectors as provided in block 124.

Figure 5:
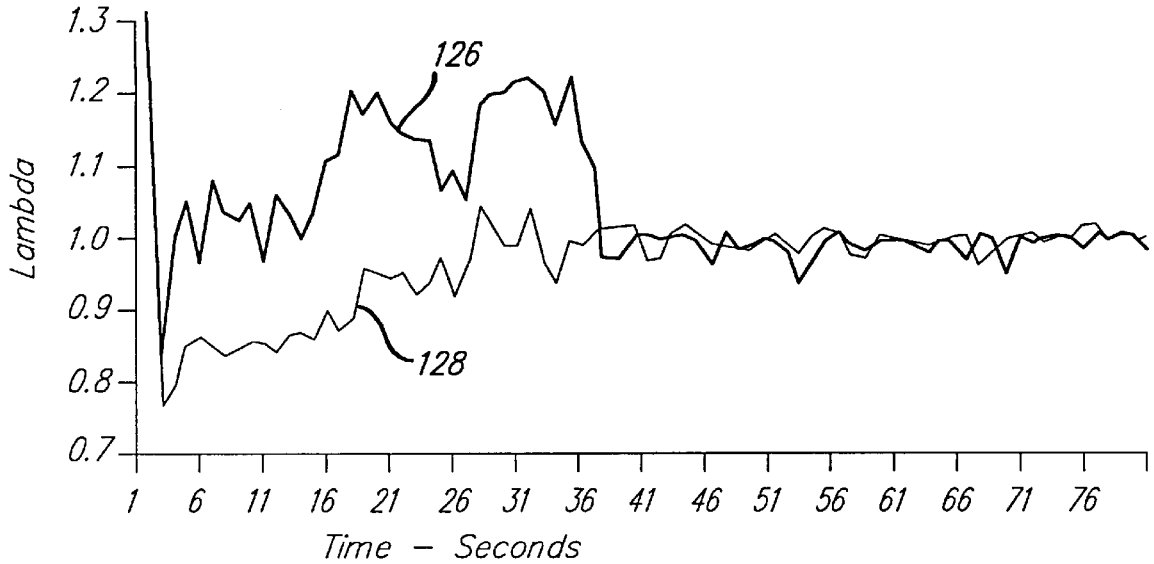
FIG. 5 is a graph illustrating engine fuel injection modification and shows a programmed fuel control curve contrasted with a modified fuel control curve.

In order to illustrate operation of the fuel injection modification methodology 100, FIG. 5 illustrates a programmed target fuel injection curve 126 contrasted with a reduced fuel injection curve 128 as provided by the fuel modification multiplier determined as described in connection with FIG. 4. For a period of time following vehicle startup, the fuel modification methodology 100 utilizes the combustion metric value so as to reduce the amount of fuel injected into the individual cylinders of the engine as may be appropriate to reduce hydrocarbon emissions emitted from the vehicle. The time period for modifying the fuel injection preferably lasts long enough until effective feedback control with the oxygen sensor may be realized. The time period may be set for forty seconds, according to one example, however, varying time periods may be necessary depending upon the engine, temperature, fuel combustibility as well as other factors. According to the example shown, it is preferred that the fuel modification methodology 100 be utilized to reduce the amount of fuel injected into the engine. It is also preferred that the modified fuel injection curve 128 does not exceed the programmed target fuel injection curve 126.

Figure 6:
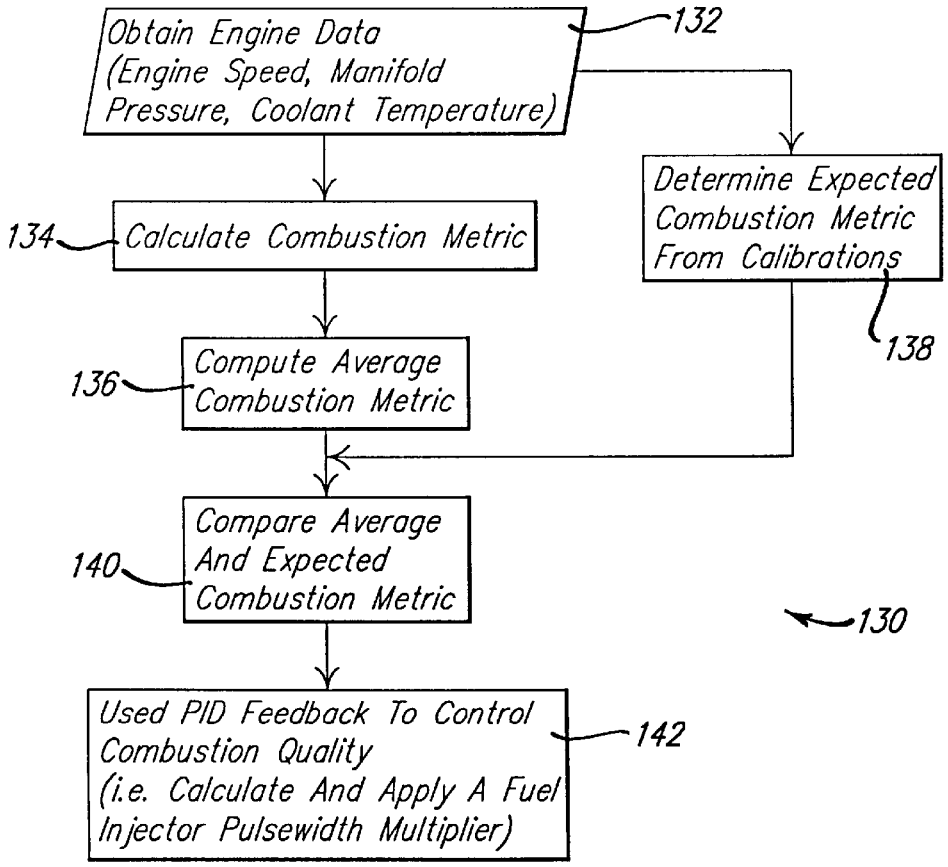
FIG. 6 is a flow diagram further illustrating the methodology of calculating the learned combustion metric value and modifying fuel injection to the engine according to the present invention.

Referring to FIG. 6, a methodology 130 is illustrated for both computing a learned combustion-related value and utilizing the combustion-related value to provide fuel modification to fuel injectors of the engine. Methodology 130 begins with block 132 to obtain engine data such as engine speed, manifold absolute pressure and coolant temperature. Methodology 130 proceeds to block 134 to calculate the combustion metric value as was described above in connection with FIG. 3. An average combustion metric value is computed pursuant to block 136. Also, a determined expected combustion metric value is determined from the engine data and calibrations as provided in block 138. The computed average combustion metric value and the determined expected combustion metric value are compared via block 140 to provide a difference output between the two input signals. According to block 142, methodology 100 uses proportional-integral-differential (PID) control to control the combustion quality of the engine by calculating and applying a fuel injector pulsewidth multiplier to the programmed fuel injection signal to reduce the amount of fuel applied to the engine. Fuel reduction is provided, yet maintaining adequate driveability and performance of the vehicle, with reduced emissions when possible, especially following a cold engine start of the vehicle. Accordingly, the modified fuel injection reduces hydrocarbon emissions while maintaining good driveability of the vehicle when the oxygen sensor and/or feedback control may not be available.

It should be appreciated that the learned combustion-related value of the present invention provides an indication of engine roughness. While the preferred embodiment utilizes the learned combustion-related value to modify fuel injection to achieve reduced hydrocarbon emissions, it should be appreciated that other applications of the learned combustion-related value may exist.

While a specific embodiment of the invention has been shown and described in detail to illustrate the principles of the present invention, it should be understood that the invention may be embodied otherwise without departing from such principles. For example, one skilled in the art will readily recognize from such discussion and from the accompanying drawings that various changes, modifications and variations can be made without departing from the spirit and scope of the present invention as described in the following claims.

What is claimed is:

1. A method of determining and indication of internal combustion engine combustion quality, the method comprising the steps of:

sensing engine speed for each expected firing of individual cylinders of the internal combustion engine;

determining a band-pass-filtered acceleration estimate value as a function of sensed engine speed;

determining a difference between a current acceleration estimate value and a preceding acceleration estimate value to provide an acceleration difference value; and determining the indication of internal combustion engine combustion quality as a function of the acceleration difference value.

2. The method of claim 1 wherein the step of determining the acceleration estimate value comprises determining a difference in engine speed for a selected cylinder firing and a cylinder firing occurring two expected cylinder firings prior to the selected cylinder firing.

3. The method of claim 1 wherein the determined indication of combustion quality is used to alter an amount of fuel injected into the internal combustion engine.

4. A method of controlling fuel injection with fuel injectors to an internal combustion engine, said method comprising the steps of:

measuring engine speed for each expected firing of individual cylinders of the internal combustion engine;

determining a band-pass-filtered acceleration estimate value as a function of measured engine speed;

determining a difference in successive expected acceleration values so as to provide for an acceleration difference value;

determining a learned combustion related value as a function of the acceleration difference value; and modifying a fuel injection pulse width signal as a function of the learned combustion related value.

* * * * *